US010669791B2

(12) United States Patent
Smith et al.

(10) Patent No.: US 10,669,791 B2
(45) Date of Patent: Jun. 2, 2020

(54) SYSTEM AND METHOD FOR INSTALLING OR REMOVING A SEAL SUB FROM A RISER

(71) Applicant: Cameron International Corporation, Houston, TX (US)

(72) Inventors: Terry Jason Smith, Friendswood, TX (US); Karina Yanet Rivera, Spring, TX (US); Roger David Boisjolie, Houston, TX (US)

(73) Assignee: Cameron International Corporation, Houston, TX (US)

( * ) Notice: Subject to any disclaimer, the term of this patent is extended or adjusted under 35 U.S.C. 154(b) by 560 days.

(21) Appl. No.: 15/391,624

(22) Filed: Dec. 27, 2016

(65) Prior Publication Data

US 2017/0183924 A1 Jun. 29, 2017

Related U.S. Application Data

(60) Provisional application No. 62/272,413, filed on Dec. 29, 2015.

(51) Int. Cl.

| | |
|---|---|
| ***E21B 19/16*** | (2006.01) |
| ***E21B 19/00*** | (2006.01) |
| ***E21B 17/08*** | (2006.01) |

(52) U.S. Cl.
CPC ..... *E21B 19/167* (2013.01); *E21B 17/085* (2013.01); *E21B 19/002* (2013.01)

(58) Field of Classification Search
CPC ..... E21B 19/167; E21B 19/002; E21B 17/085
USPC ..... 166/367
See application file for complete search history.

(56) References Cited

U.S. PATENT DOCUMENTS 5,881,420 A * 3/1999 Bruckelmyer ..... B08B 9/0436 138/89

* cited by examiner

*Primary Examiner* — Anna M Momper
*Assistant Examiner* — Patrick F Lambe

(57) ABSTRACT

A tool configured to facilitate installation or removal of a seal sub from an annular structure includes a support structure configured to be coupled to the annular structure, a shaft extending axially from the support structure, and an engaging structure coupled to the shaft. The engaging structure includes a plurality of engaging members, and each of the plurality of engaging members is configured to move in a radial direction between a retracted position that enables the engaging structure to be inserted into the seal sub and an extended position that enables the respective engaging member of the plurality of engaging members to engage the seal sub.

19 Claims, 9 Drawing Sheets

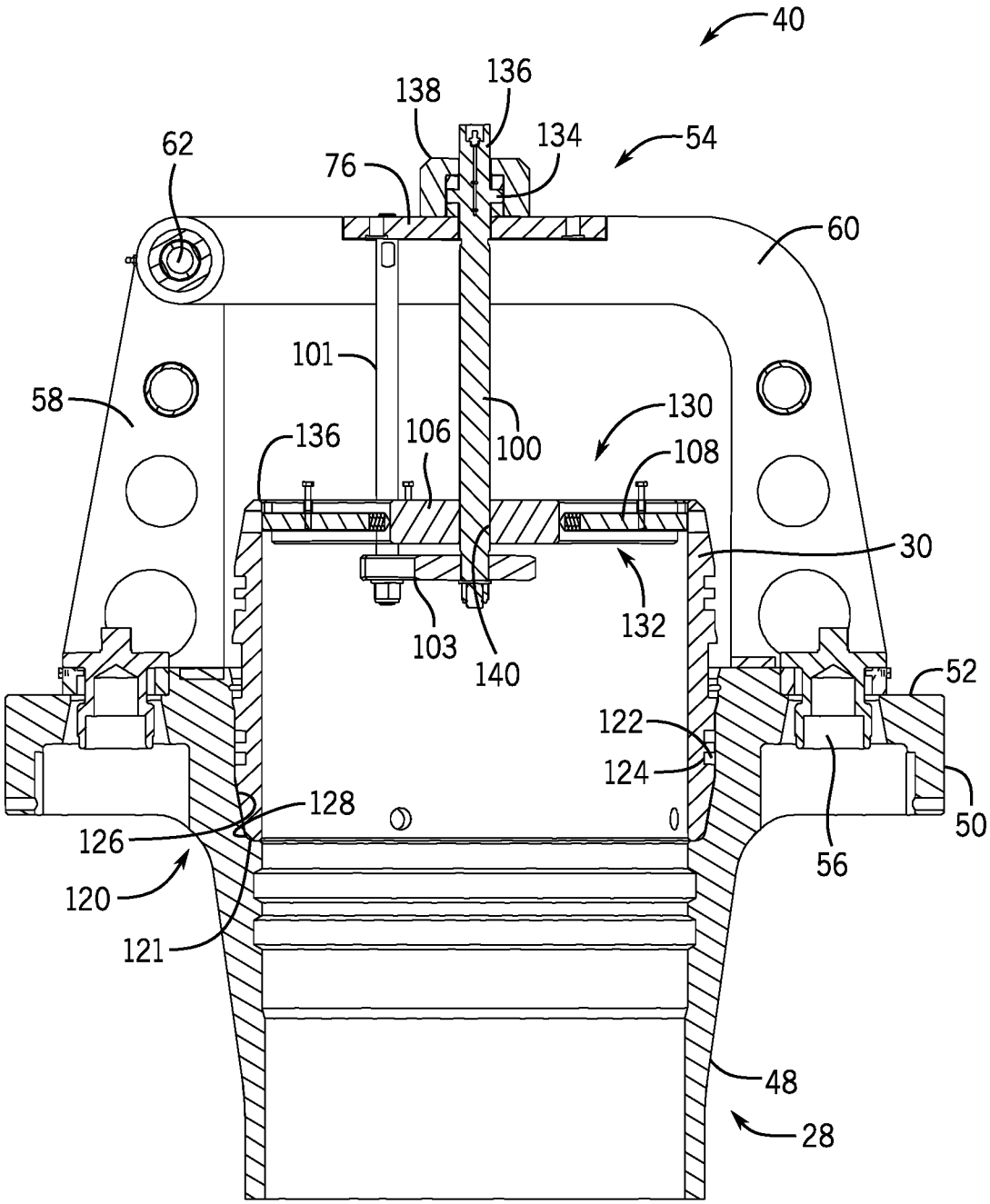
FIG. 3
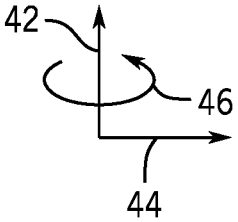

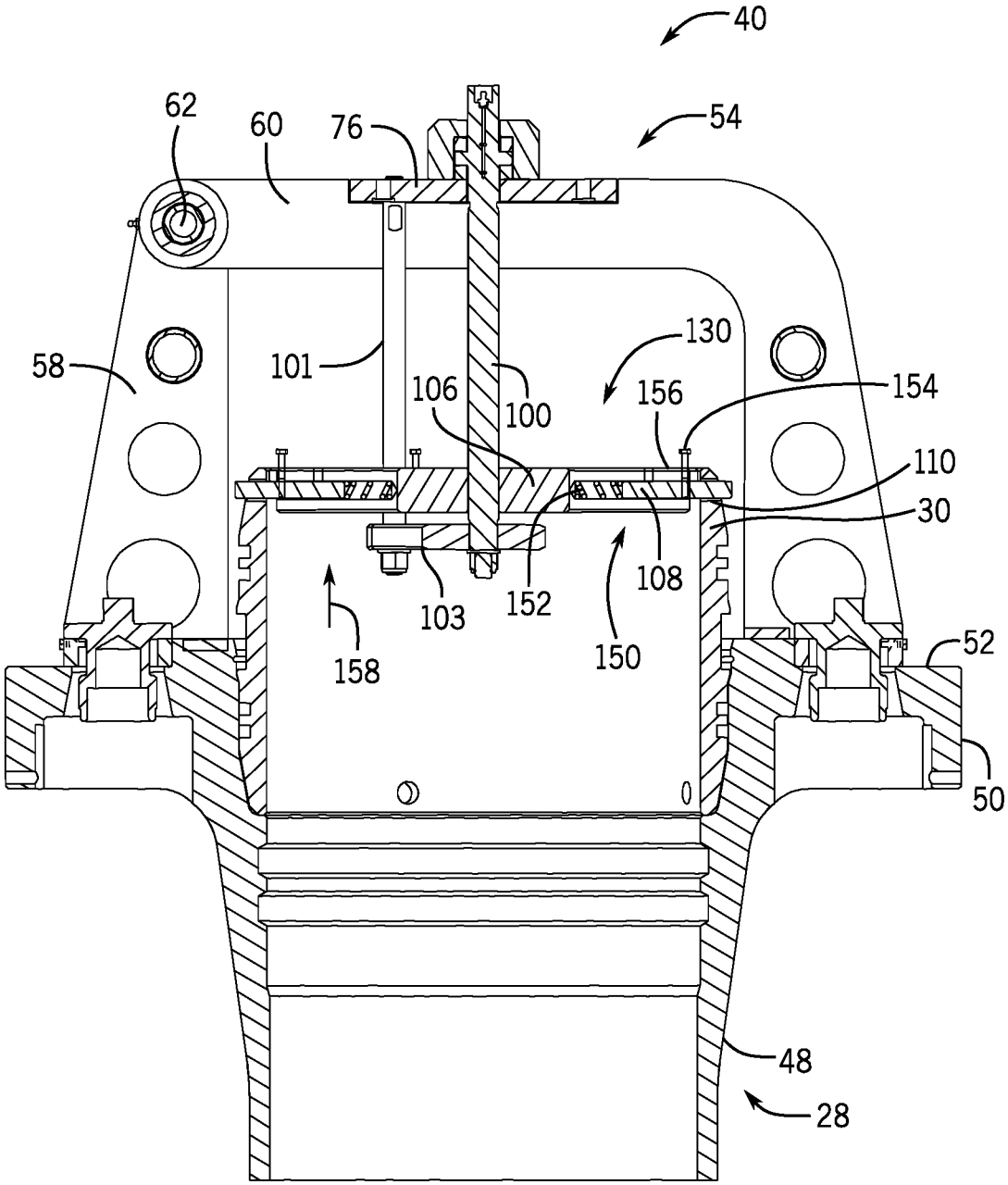
FIG. 4
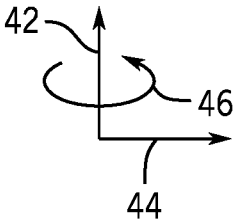

SYSTEM AND METHOD FOR INSTALLING OR REMOVING A SEAL SUB FROM A RISER

CROSS-REFERENCE TO RELATED APPLICATION

This application claims priority from and the benefit of U.S. Provisional Patent Application No. 62/272,413, entitled "SYSTEM AND METHOD FOR INSTALLING OR REMOVING A SEAL SUB FROM A RISER," filed Dec. 29, 2015, which is hereby incorporated by reference in its entirety for all purposes.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Natural resources, such as oil and gas, are used as fuel to power vehicles, heat homes, and generate electricity, in addition to various other uses. Once a desired resource is discovered below the surface of the earth, drilling and production systems are often employed to access and extract the resource. An offshore drilling system may include a riser that connects a drilling rig to a wellhead assembly supported by the ocean floor. The riser may include multiple riser sections coupled to one another between the drilling rig and the wellhead assembly, and a seal (e.g., seal sub) may be provided at a connection between adjacent riser sections to seal the connection and to block fluid from flowing out of the riser.

BRIEF DESCRIPTION OF THE DRAWINGS

Various features, aspects, and advantages of the present invention will become better understood when the following detailed description is read with reference to the accompanying figures in which like characters represent like parts throughout the figures, wherein:

FIG. 3 is a cross-sectional side view of the tool of FIG. 2, wherein engaging members of the tool are positioned within the seal seated within the riser;

FIG. 4 is a cross-sectional side view of the tool of FIG. 2, wherein the engaging members of the tool engage the seal;

DETAILED DESCRIPTION OF SPECIFIC EMBODIMENTS

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

The present embodiments are generally directed to systems and methods for removing and/or installing a seal (e.g., annular seal sub) within an annular structure (e.g., riser) of an offshore drilling system. In particular, the present embodiments include a tool having a support structure that is configured to couple to an end of a riser section. The tool may also include engaging members that are configured to engage the seal (e.g., via radial expansion) and to move (e.g., axially) relative to the support structure to facilitate installation and/or removal of the seal within the riser section. The disclosed embodiments may advantageously enable efficient installation and/or removal of the seal within the riser section and/or may reduce an amount of manual labor associated with installation and/or removal of the seal within the riser section. In some cases, the disclosed embodiments may limit wear and/or damage to the seal and/or the riser section that may occur during manual installation and/or removal of the seal (e.g., due to dropping the seal, using inappropriate tools to pry the seal from the riser section, or the like). The disclosed embodiments may be utilized in a variety of locations, including a manufacturing facility or an offshore platform.

Figure 1:
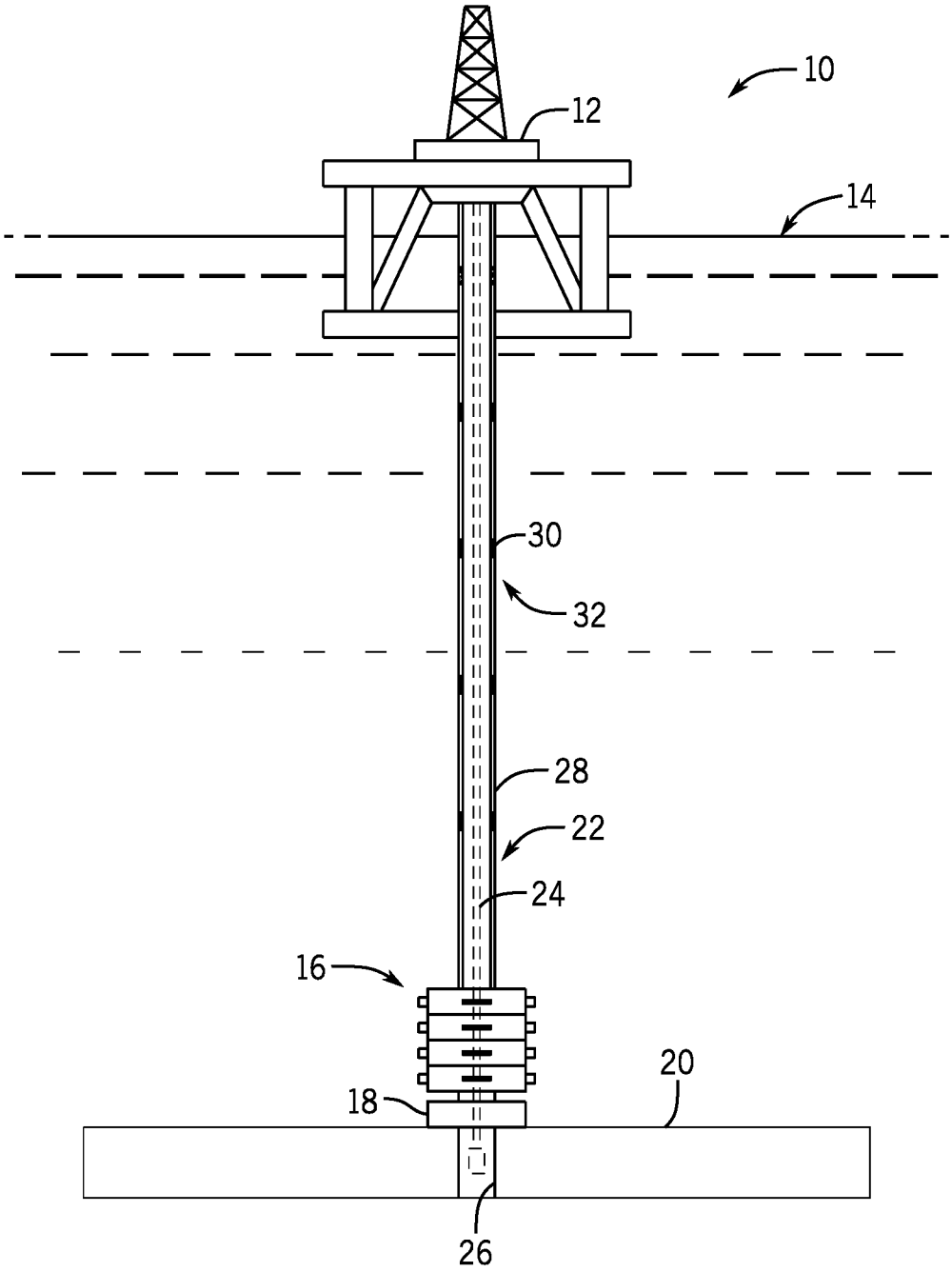
FIG. 1 is a schematic diagram of an offshore system in accordance with an embodiment of the present disclosure.

With the foregoing in mind, FIG. 1 is an embodiment of an offshore system 10. The offshore system 10 includes an offshore vessel or platform 12 at an ocean surface 14. The platform 12 may support various types of drilling equipment. Some drilling equipment, such as a BOP stack 16, may be mounted to a wellhead 18 at an ocean floor 20. A riser 22 (e.g., tubular drilling riser) extends from the platform 12 toward the wellhead 18. The riser 22 may return drilling fluid or mud to the platform 12 during drilling operations. Downhole operations are carried out by a tubular string 24 (e.g., drill string, production tubing string, or the like) that extends from the platform 12, through the riser 22, and into a wellbore 26.

In some embodiments, the riser 22 includes multiple riser sections 28 coupled to one another. A seal 30 (e.g., annular seal or seal sub) may be provided (e.g., seated within the riser 22) at a connection 32 between adjacent riser sections 28 to seal the connection 32 and to block fluid from flowing out of the riser 22. Occasionally (e.g., during maintenance operations), the riser sections 28, with respective seals 30 coupled thereto, may be removed from the ocean and/or placed onto the platform 12 for inspection, cleaning, repair, and/or replacement, for example. For example, in some cases, it may be desirable to remove the seal 30 from the riser section 28 to clean certain surfaces of the riser section 28, to inspect the seal 30, and/or to replace annular sealing members of the seal 30. It may also be desirable to efficiently re-install the seal 30 or to install a new seal 30 once the maintenance operations are complete. The disclosed embodiments may also be used during assembly of the riser sections 28 (e.g., in a factory and/or prior to placement in the ocean), when it may be desirable to efficiently install a new seal 30. The seal 30 may be a generally large, heavy component, and the seal 30 may be seated (e.g., lodged or wedged) within the riser section 28 such that the seal 30 cannot be easily removed and/or installed manually. Accordingly, it would be desirable to have a system that facilitates efficient removal and/or installation of the seals 30 within the riser sections 28.

Figure 2:
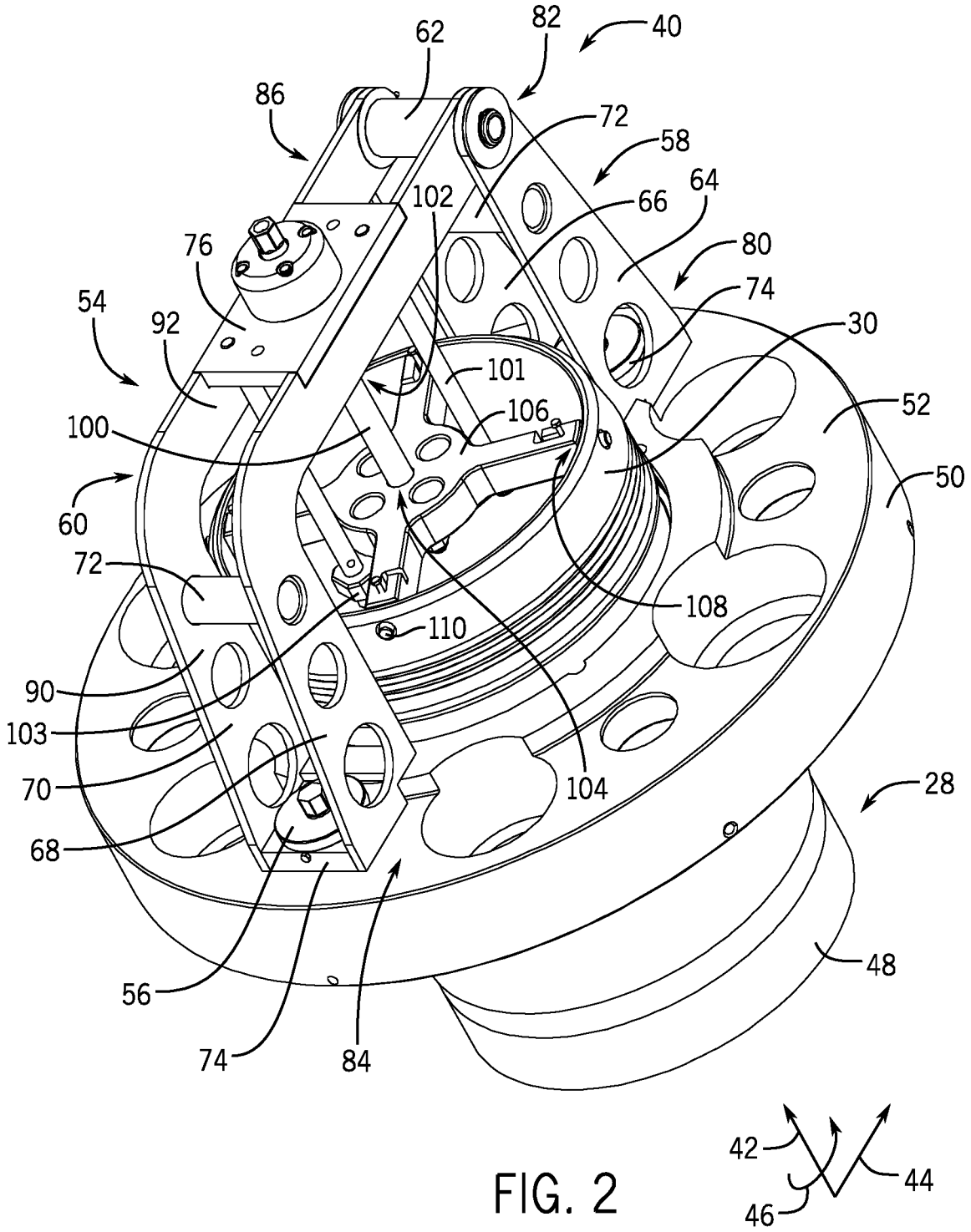
FIG. 2 is a perspective view of a tool that may be used to install and/or to remove a seal from a riser of the offshore system of FIG. 1 in accordance with an embodiment of the present disclosure.

FIG. 2 is a perspective view of an embodiment of a tool 40 that may be used to remove and/or to install the seal 30 from the riser section 28. To facilitate discussion, the riser section 28, the seal 30, and the tool 40 and its components may be described with reference to an axial axis or direction 42, a radial axis or direction 44, and a circumferential axis or direction 46.

As shown, the riser section 28 includes a body 48 (e.g., annular or tubular body) and a flange 50 (e.g., annular flange) having an axially-facing surface 52 (e.g., top or upper annular surface). The tool 40 includes a support structure 54 that is configured to be coupled to the flange 50 via fasteners 56 (e.g., threaded fasteners). In the illustrated embodiment, the support structure 54 includes a first arm 58 (e.g., axially-extending arm) coupled to a second arm 60 (e.g., L-shaped arm) via a rotatable coupling 62 (e.g., pivot, pin, or hinge). In the illustrated embodiment, each of the first arm 58 and the second arm 60 includes respective parallel plates. In particular, the first arm 58 includes a first plate 64 and a second plate 66 that are parallel to one another and/or are each generally perpendicular to the axially-facing surface 52 of the flange 50 of the riser section 28. The second arm 60 also includes a first plate 68 and a second plate 70 that are parallel to one another and/or are each generally perpendicular to the axially-facing surface 52 of the flange 50 of the riser section 28.

The plates 64, 66 of the first arm 58 may be coupled to one another via any of a variety of coupling devices or structures, including one or more bars 72 (e.g., support bars or pins) and/or one or more panels 74 (e.g., support panels or plates) extending between the plates 64, 66. Similarly, the plates 68, 70 of the second arm 60 may be coupled to one another via any of a variety of coupling devices or structures, including one or more bars 72 and/or one or more panels 74 extending between the plates 68, 70. As shown, the plates 68, 70 of the second arm 60 are also coupled to one another and/or supported by a bracket 76. The illustrated configuration of the support structure 54 may provide a stable and generally light-weight tool 40 that can be moved or lifted by an operator.

In the illustrated embodiment, the support structure 54 is generally U-shaped. Although two arms 58, 60 are shown, it should be understood that the support structure 54 may include any suitable number (e.g., 1, 2, 3, 4, 5, 6, or more) arms positioned at discrete locations about the circumference of the tool 40. The first arm 58 of the support structure 54 has a first end 80 and a second end 82. The first end 80 is coupled to the flange 50 via a respective fastener 56, and the second end 82 is coupled to a second arm 60 of the support structure 54 via the rotatable coupling 62. A first end 84 of the second arm 60 is coupled to the flange 50 via a respective fastener 56, and a second end 86 of the second arm 60 is coupled to the first arm 58 via the rotatable coupling 62. In the illustrated embodiment, the second arm 60 is generally L-shaped with a first axially-extending portion 90 and a second radially-extending portion 92 that is configured to be substantially parallel to the axially-facing surface 52 of the flange 50 when the support structure 54 is coupled to the riser section 28.

As shown, the support structure 54 is coupled to the flange 50 via two fasteners 56 positioned at approximately 180 degrees from each other about the circumference of the flange 50. In the illustrated embodiment, one fastener 56 is positioned between the respective plates 64, 66 of the first arm 58, one fastener 56 is positioned between the respective plates 68, 70 of the second arm 60, and each fastener 56 extends through a respective support panel 64 to the flange 50 to couple the support structure 54 to the flange 50.

A shaft 100 (e.g., axially-extending shaft or threaded shaft) is supported by and extends axially from the support structure 54 (e.g., from the bracket 76 that is positioned along the radially-extending portion 92 of the support structure 54). In some embodiments, the tool 40 may include one or more support bars 101 (e.g., axial guides or anti-rotation bars) extending between the support structure 54 and a stop 103 (e.g., plate). In the illustrated embodiment, a first portion 102 of the shaft 100 is coupled to the support structure 54 via the bracket 76, and a second portion 104 of the shaft 100 is coupled to an engaging structure 106. The engaging structure 106 includes one or more radially-extending engaging members 108 and is rotatably coupled to the shaft 100 (e.g., via threads) such that rotation of the shaft 100 causes the engaging structure 106 to move axially along the shaft 100 between the support structure 54 and the stop 103.

As shown, the engaging structure 106 is an x-shaped structure and includes four radially-extending engaging members 108 positioned at discrete circumferential locations. The engaging structure 106 may include any suitable number of radially-extending members 108 (e.g., 1, 2, 3, 4, 5, 6, 7, 8, 9, 10, or more), which may have any suitable spacing (e.g., be evenly or unevenly spaced at circumferential locations) to facilitate engaging corresponding recesses 110 (e.g., openings, apertures, grooves, or the like) of the seal 30. As discussed in more detail below, the engaging members 108 may be configured to move radially between a retracted position (e.g., a radially-retracted position) in which the engaging members 108 do not engage and/or contact the seal 30 and an expanded position (e.g., radially-expanded position) in which the engaging members 108 engage and contact the recesses 110 of the seal 30.

FIG. 3 is a cross-sectional side view of an embodiment of the seal 30 in a seated position 120 within the riser section 28. In the seated position 120, the seal 30 may contact a seating surface 121 (e.g., axially-facing surface) of the riser section 28, and the seal 30 (e.g., via annular sealing members 122 within annular sealing grooves 124 of the seal 30) may block a flow of fluid between an inner surface 126 of the riser section 28 and an outer surface 128 of the seal 30. As shown, the engaging structure 106 of the tool 40 is in a first position 130 (e.g., lowered position or distal position) proximate to the second section 104 of the shaft 100, and the engaging members 108 of the tool 40 are in a retracted position 132 (e.g., radially-retracted position) in which the engaging members 108 do not contact the seal 30 and/or do not engage the recesses 110 in the seal 30. When the engaging members 108 are in the retracted position 132, the engaging structure 106 may fit within and/or may be inserted into the seal 30.

As shown, the support structure 54 is coupled to the axially-facing surface 52 of the flange 50 of the riser section 28 via fasteners 56. The first arm 58 and the second arm 60 are coupled to one another via the rotatable coupling 62, and the shaft 100 extends axially from the support structure 54 (e.g., via the bracket 76). The shaft 100 is configured to rotate relative to the support structure 54, but does not move axially relative to the support structure 54. For example, an operator may couple a tool (e.g., wrench or impact gun) to a first end 136 of the shaft 100 and may apply a rotational force to the shaft 100. A bearing may be provided between the shaft 100 and the support structure 54 (e.g., at the bracket 76), and thus, the shaft 100 does not move axially relative to the support structure 54 in response to the rotational force. In some embodiments, a radially-extending flange 134 (e.g., annular flange) may extend from the shaft 100 and may interact with a housing 138, the support structure 54, and/or the bracket 76 to block or to limit axial movement of the shaft 100 relative to the support structure 54.

As shown, the stop 103 extends radially outward from the second portion 104 of the shaft 100. The support bars 101 extend between the support structure 54 and the stop 103 to block undesirable movement (e.g., in the axial direction 42) of the shaft 100 and/or to support the shaft 100. The engaging structure 106 is threadably coupled to the shaft 100 via a threaded connection 140, and the engaging members 108 extend radially outward from the shaft 100.

When the tool 40 is coupled to the riser section 28, the shaft 100 extends axially through an opening 136 of the seal 30. Rotation of the shaft 100 may cause the engaging structure 106 to move axially relative to the shaft 100 along the threaded connection 140. Thus, by rotating the shaft 100, the engaging structure 106 may be moved to the illustrated first position 130 to axially align the engaging members 108 with the recesses 110 of the seal 30. Once the engaging members 108 are axially aligned with the recesses 110 of the seal 30, the engaging members 108 may be moved radially from the retracted position 132 to an expanded position (e.g., radially-expanded position) in which the engaging members 108 engage and contact the recesses 110 of the seal 30, as discussed below.

FIG. 4 is a cross-sectional side view of an embodiment of the engaging structure 106 in the first position 130 with the engaging members 108 in an expanded position 150 (e.g., radially-expanded position). In the expanded position 130, the engaging members 108 engage and contact the recesses 110 of the seal 30. The engaging members 108 may be configured to move from the retracted position 132 to the expanded position 150 via any suitable drive member. For example, in the illustrated embodiment, each of the engaging members 108 is biased radially outward by a respective biasing member 152 (e.g., spring). As discussed in more detail below, a respective pin 154 may be coupled to each of the engaging members 108 and may extend through and move within a recess 156 (e.g., an L-shaped recess) formed in the engaging structure 106. For example, when the pin 154 is in a first position within the recess 156 (e.g., circumferentially-extending recess portion or slot), the pin 154 may block the engaging member 108 from expanding radially outward into the expanded position 150. When the pin 154 is in a second position within the recess 156 (e.g., radially-extending recess portion or slot), the pin 154 may enable the biasing member 152 to drive the engaging member 108 radially outward from the retracted position 132 to the expanded position 150. The pin 54 may be moved manually by an operator, although the pin 154 may be moved via remote control, electronic control, electric drive, fluid-driven actuators (e.g., hydraulic actuators, pneumatic actuators, etc.), or the like. While the engaging members 108 engage the recesses 110 of the seal 30, rotation of the shaft 100 (e.g., via a wrench or impact gun) may drive the engaging structure 106 and the engaged seal 30 axially upward, as shown by arrow 158, thereby unseating (e.g., dislodging, withdrawing, or separating) the seal 30 from the riser section 28.

Figure 5:
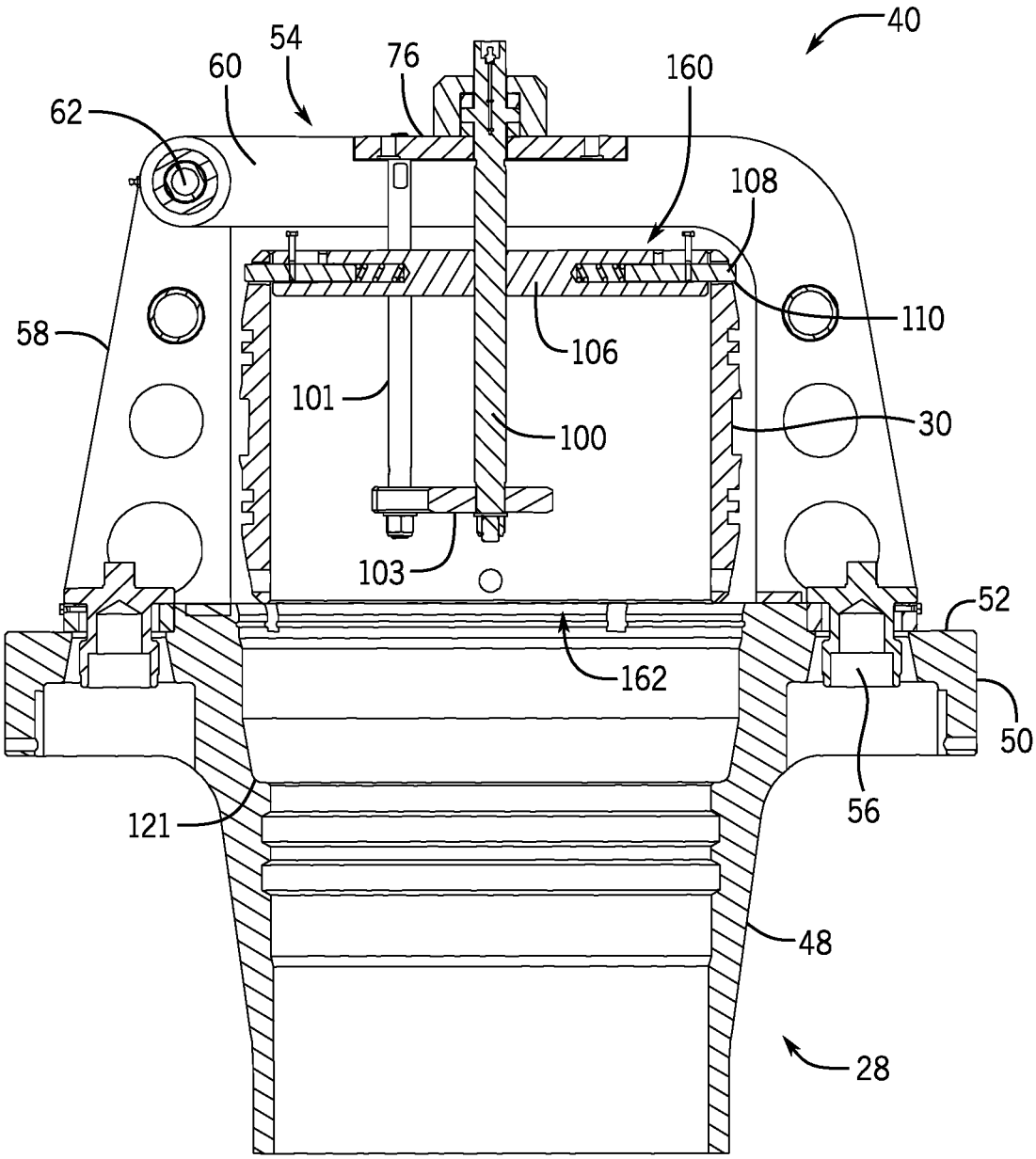
FIG. 5 is a cross-sectional side view of the tool of FIG. 2, wherein the seal is withdrawn from the riser.
Figure 5:
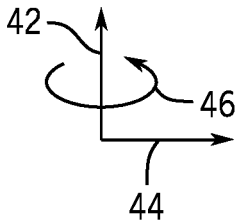

FIG. 5 is a cross-sectional side view of an embodiment of the engaging structure 106 in a second position 160 (e.g., raised position) and the seal 30 in a withdrawn position 162. In the withdrawn position 162, the seal 30 is separated from the riser section 28 and/or does not contact the seating surface 121 of the riser section 28. As discussed above, while the engaging members 108 engage the recesses 110 of the seal 30, the engaging structure 106 may be driven axially upward relative to the support structure 54 via rotation of the shaft 100 along a threaded connection 40 between the shaft 100 and the engaging structure 106, thereby causing the seal 30 to move from the seated position 120 to the withdrawn position 162.

Figure 6:
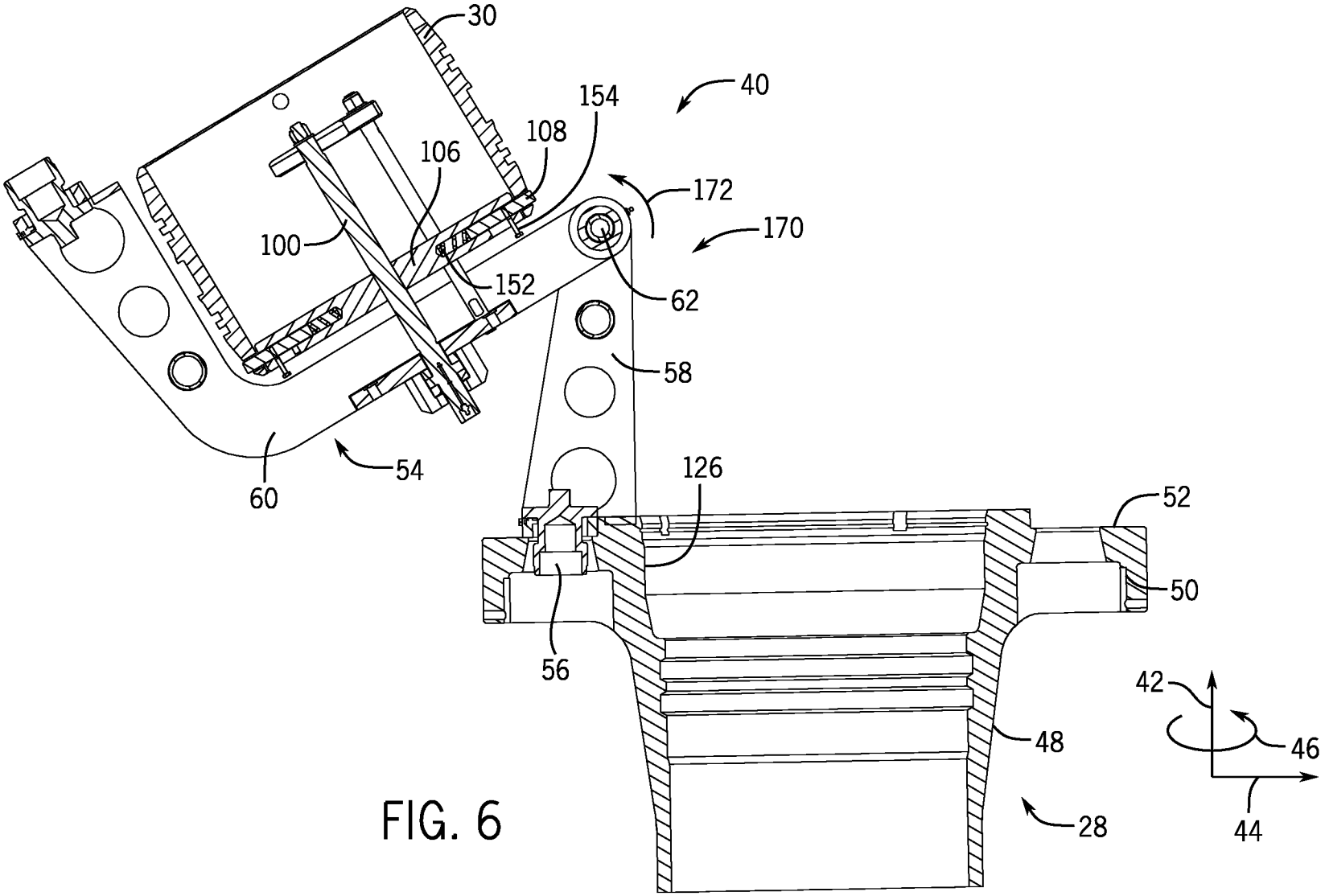
FIG. 6 is a cross-sectional side view of the tool of FIG. 2, wherein the tool is in an open position.
Figure 7:
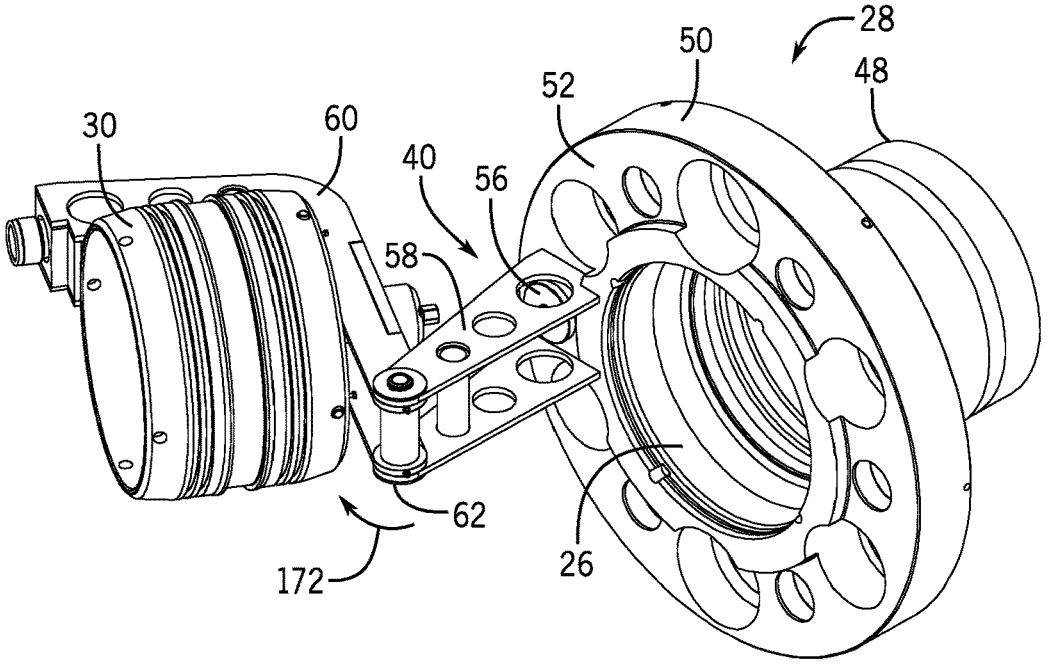
FIG. 7 is a perspective view of the tool of FIG. 2, wherein the tool is in the open position.

FIG. 6 is a cross-sectional side view of an embodiment of the tool 40 rotated into an open position 170, and FIG. 7 is a perspective view of an embodiment of the tool 40 rotated into the open position 170. In the open position 170, the first arm 58 of the tool 40 may remain attached to the riser section 28 via a respective fastener 56, and the second arm 60 of the tool 40 may be unattached from the riser section 28 (e.g., unfastened and separated from the riser section 28) to facilitate inspection of the riser section 28 and/or the seal 30. With the seal 30 attached to the second arm 60 while the tool 40 is in the open position 170, an operator may be able to visually inspect and/or replace the annular sealing members on the seal 30, efficiently replace the seal 30, and/or clean the inner surface 126 of the riser section 28.

In the illustrated embodiment, to move the tool 40 into the open position 170, the second arm 60 of the tool 40 may be rotated about the rotatable coupling 62, as shown by arrow 172. The steps shown in FIGS. 2-6 may be carried out with the riser section 28 in a vertical position and the tool 40 positioned vertically above the riser section 28. However, in some embodiments, the riser section 28 may be placed in a horizontal position (e.g., on its side). Such placement of the riser section 28 may facilitate inspection and/or access to the riser section 28 and/or the seal 30. Such placement of the riser section 28 may also reduce the labor involved in mounting the tool 40 on the riser section 28 and/or in moving the tool 40 into the open position 170. For example, when the riser section 28 is placed in the horizontal position, the operator may rotate (e.g., swing) the tool 40 to the side (e.g., horizontally) in a similar manner to opening a door.

Figure 8:
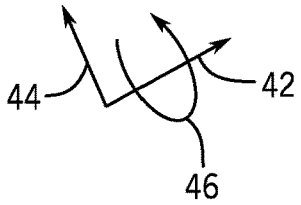
FIG. 8 is a side view of a portion of the tool of FIG. 2.
Figure 8:
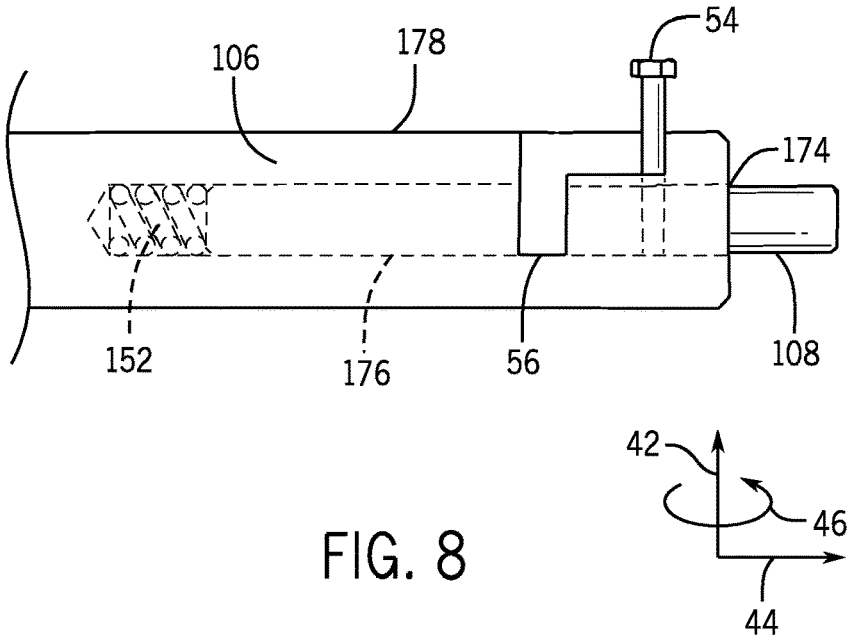

FIG. 8 is a side view a portion of the engaging structure 106 with the biasing member 152 (e.g., spring), pin 154, the recess 156, and the engaging member 108. As shown, the engaging member 108 protrudes radially outward from the engaging structure 106 and is in the expanded position 150 in which the engaging member 108 is configured to engage the recess 110 of the seal 30. In particular, the engaging member 108 is disposed within and extends radially outward from an opening 174 of a chamber 176 extending radially through the engaging structure 106. The biasing member 152 is positioned at one end (e.g., radially-inward) of the chamber 176 and is in an uncompressed position in which the biasing member 152 biases the engaging member 108 radially outward and drives the engaging member 108 into the expanded position 150. The pin 154 is coupled (e.g., fixed or attached) to the engaging member 108 and extends out of the recess 156 formed in a wall 178 of the engaging structure 106. As shown, the recess 156 is generally L-shaped and has a first portion 180 (e.g., radially-extending recess portion or slot) and a second portion 182 (e.g., circumferentially-extending recess portion or slot), which may be generally perpendicular to the first portion 180. When the pin 154 is positioned in the first portion 180 of the recess 156, the biasing member 152 may drive the engaging member 108 into the expanded position 150. When the pin 154 is positioned in the second portion 182 of the recess 156, the engaging member 108 may be in the retracted position 132 and the biasing member 152 may be held (e.g., locked) in a compressed position. Thus, when the pin 154 is positioned in the second portion 182 of the recess 156, the engaging member 108 may be blocked from moving to the expanded position 150. In some embodiments, the pin 154 may be accessible to and manually movable by the operator between the first portion 180 and the second portion 182 of the recess 156. As noted above, the components illustrated in FIG. 8 are provided as an example and it should be understood that the engaging members 108 may be driven from the retracted position 132 to the expanded position 150 via any suitable drive member or drive system (e.g., electric drive, fluid drive, cable and trigger assembly, or the like).

Figure 9:
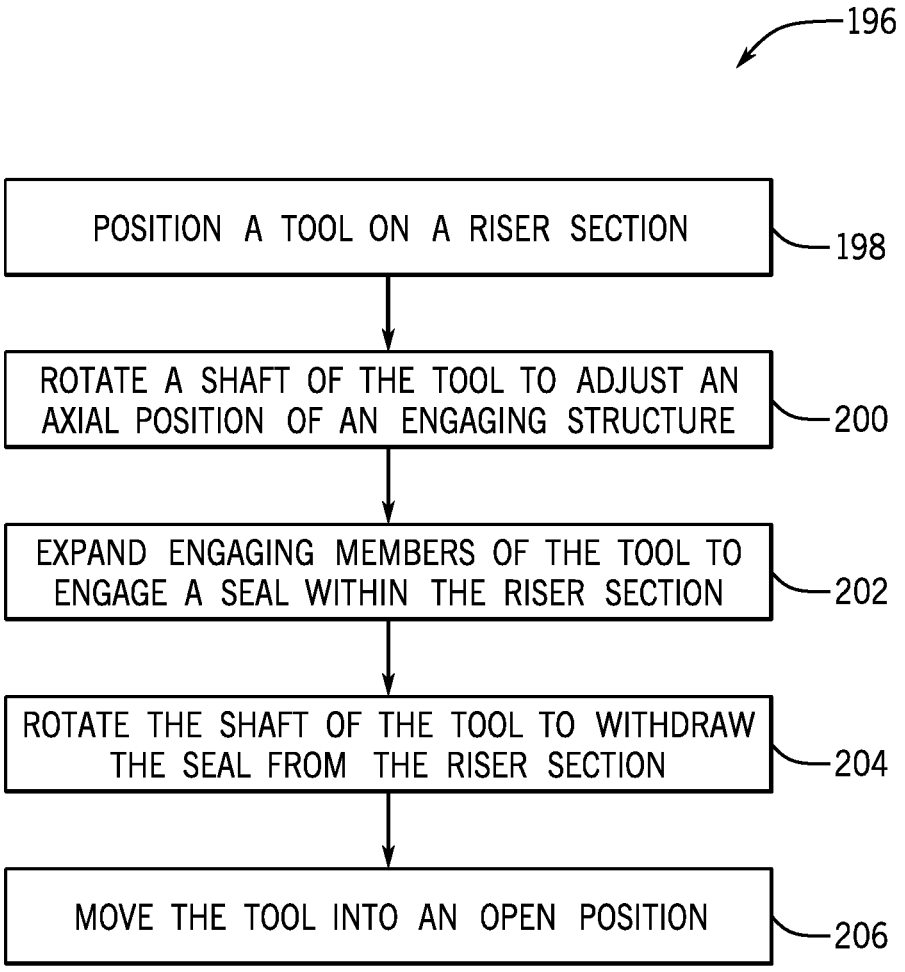
FIG. 9 is a flow diagram of a method of removing the seal from the riser using the tool of FIG. 2 in accordance with an embodiment of the present disclosure.

FIG. 9 is a flow diagram of an embodiment of a method 196 of removing the seal 30 from the riser section 28 using the tool 40. The method 196 includes various steps represented by blocks. Although the flow chart illustrates the steps in a certain sequence, it should be understood that the steps may be performed in any suitable order, and that certain steps may be omitted.

The method 196 may begin with positioning the tool 40 on the riser section 28, in step 198. The tool 40 may be stored and/or provided in one piece or as separate components. The tool 40 may be large and/or heavy, and thus, it may be desirable for the operator to individually attach the various components of the tool 40 to the riser section 28. For example, the operator may first attach the first arm 58 to the riser section 28 via the respective fastener 56, and then the operator may attach the second arm 60 to the riser section 28 via the respective fastener 56 and to the first arm 58 via the rotatable coupling 62.

In step 200, the shaft 100 may be rotated (e.g. via a tool, such as a wrench or impact gun) to adjust the axial position of the engaging structure 106 and to axially align the engaging structure 106 with the recesses 110. As discussed above, the shaft 100 is axially fixed to the support structure 54 and is threadably coupled to the engaging structure 106 via the threaded connection 140 such that rotation of the shaft 100 drives the engaging structure 106 axially along the shaft 100.

In step 202, the engaging members 108 may be moved from the retracted position 132 to the expanded position 150 in which the engaging member 150 engage the recesses 110 of the seal 30. As discussed above with respect to FIG. 8, in some embodiments, the biasing member 152, the pin 154, and the recess 156 may be provided to enable an operator to move the engaging members 108 between the retracted position 132 and the expanded position 150. For example, the operator may move the pin 154 from one portion 180 of the recess 156 to another portion 182 of the recess 156 to enable the biasing member 152 to drive the engaging members 108 radially outward into the expanded position 150.

In step 204, while the engaging members 108 engage the recesses 110 of the seal 30, the shaft 100 may be rotated (e.g., via a tool, such as a wrench or an impact gun) to move the engaging structure 106 axially upward away from the riser section 28, thereby causing the seal 30 to move from the seated position 120 to the withdrawn position 162.

In step 206, the tool 40 may be opened or moved into the open position 170. In some embodiments, to move the tool 40 into the open position 170, the second arm 60 of the tool 40 may be unattached from the riser section 28 (e.g., unfastened and rotated about the rotatable coupling 62 away from the riser section 28) to facilitate inspection of the riser section 28 and/or the seal 30. With the seal 30 attached to the second arm 60 while the tool 40 is in the open position 170, an operator may be able to visually inspect and/or replace the annular sealing members on the seal 30, efficiently replace the seal 30, and/or clean the inner surface 126 of the riser section 28. As noted above, the steps of the method 196 may be carried out with the riser section 28 in a vertical position or in a horizontal position (e.g., on its side).

If the operator chooses to replace the seal 30, the operator may detach the seal 30 from the tool 40 while the tool 40 is in the open position 170. The operator may detach the seal 30 from the tool 40 by manually moving the pins 154 to cause the engaging members 108 to disengage from the recesses 110 of the seal 30. The seal 30 may then be lifted or pulled from the tool 40 and a new seal 30 may be placed onto the tool 40. In such cases, the operator may move the pins 154 to cause the engaging members 108 to engage the recesses 110 of the new seal 30, rotate the second arm 60 about the rotatable coupling 62 to position the seal 30 axially above the body 48 of the riser section 28, and fasten the second arm 60 to the flange 50 of the riser section 28 via a respective fastener 56. Subsequent rotation of the shaft 100 may drive the new seal 30 into the seated position 120 within the riser section 28. Similar steps may be taken to efficiently install a new seal 30 into the riser section 28 at a factory and/or prior to placement of the riser section 28 in the ocean, for example.

Figure 10:
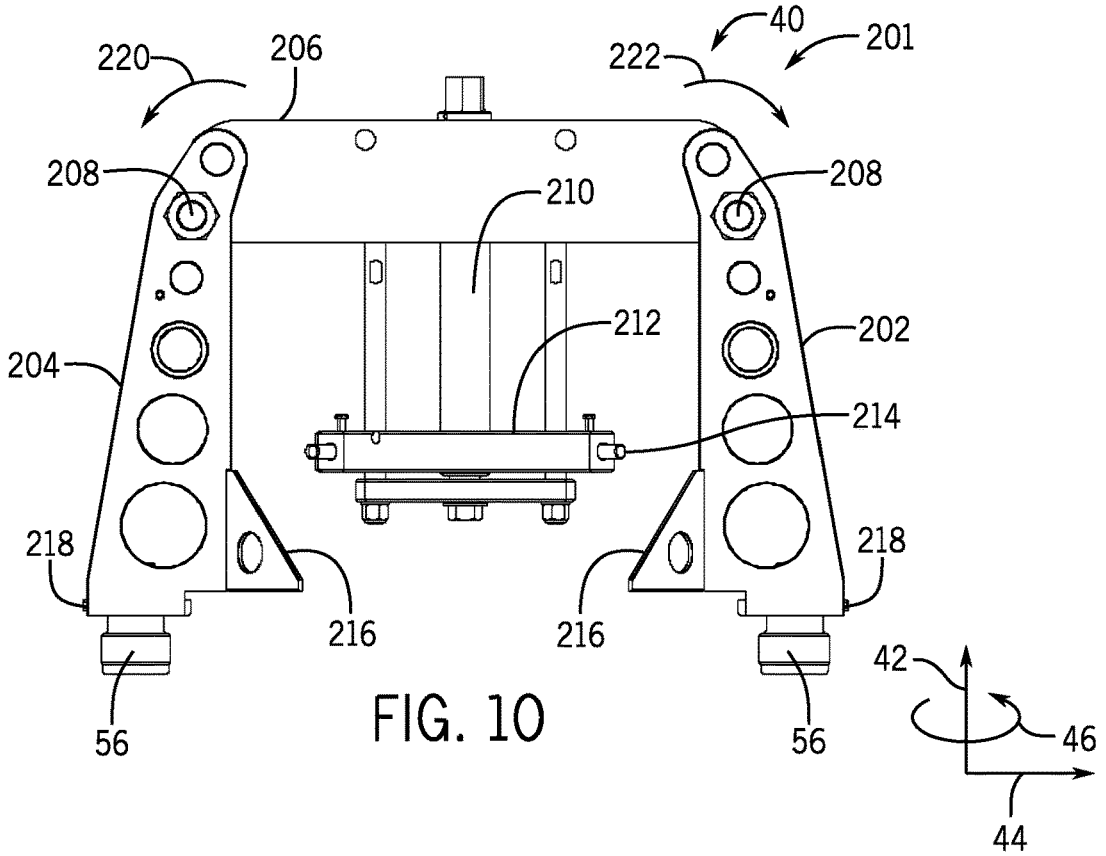
FIG. 10 is a cross-sectional side view of a tool that may be used to install and/or to remove a seal from a riser of the offshore system of FIG. 1 in accordance with an embodiment of the present disclosure.

FIG. 10 is a cross-sectional side view of another embodiment of a tool 200 that may be used to remove the seal 30 from the riser section 28. As shown, the tool 200 includes a support structure 201 having a first arm 202 (e.g., axially-extending arm) and a second arm 204 (e.g., axially-extending arm) coupled together by a third arm 206 (e.g., radially-extending arm). The third arm 206 is configured to be generally parallel to the axially-facing surface 52 of the flange 50 when the support structure 201 is coupled to the riser section 28. The first arm 202 and the second arm 204 are each configured to be coupled to the flange 50 via respective fasteners 56 and are each configured to be coupled to the third arm 206 via respective rotatable couplings 208 (e.g., hinges). Thus, the tool 200 may be configured to open in several different ways. For example, the first arm 202 may be detached from the flange 50 (e.g., via detaching the respective fastener 56), and the first arm 202 and the third arm 206 may be rotated together about the respective rotatable coupling 208, as shown by arrow 220, to move the tool 40 into the open position. In another example, the second arm 204 may be detached from the flange 50 (e.g., via detaching the respective fastener 56), and the second arm 204 and the third arm 206 may be rotated together about the respective rotatable coupling 208, as shown by arrow 222, to move the tool 200 into the open position. In another example, the third arm 206 may be detached from one of the first or second arms 202, 204 and rotated about a respective rotatable coupling 208 to move the tool 200 into the open position, as shown in FIG. 11.

Figure 11:
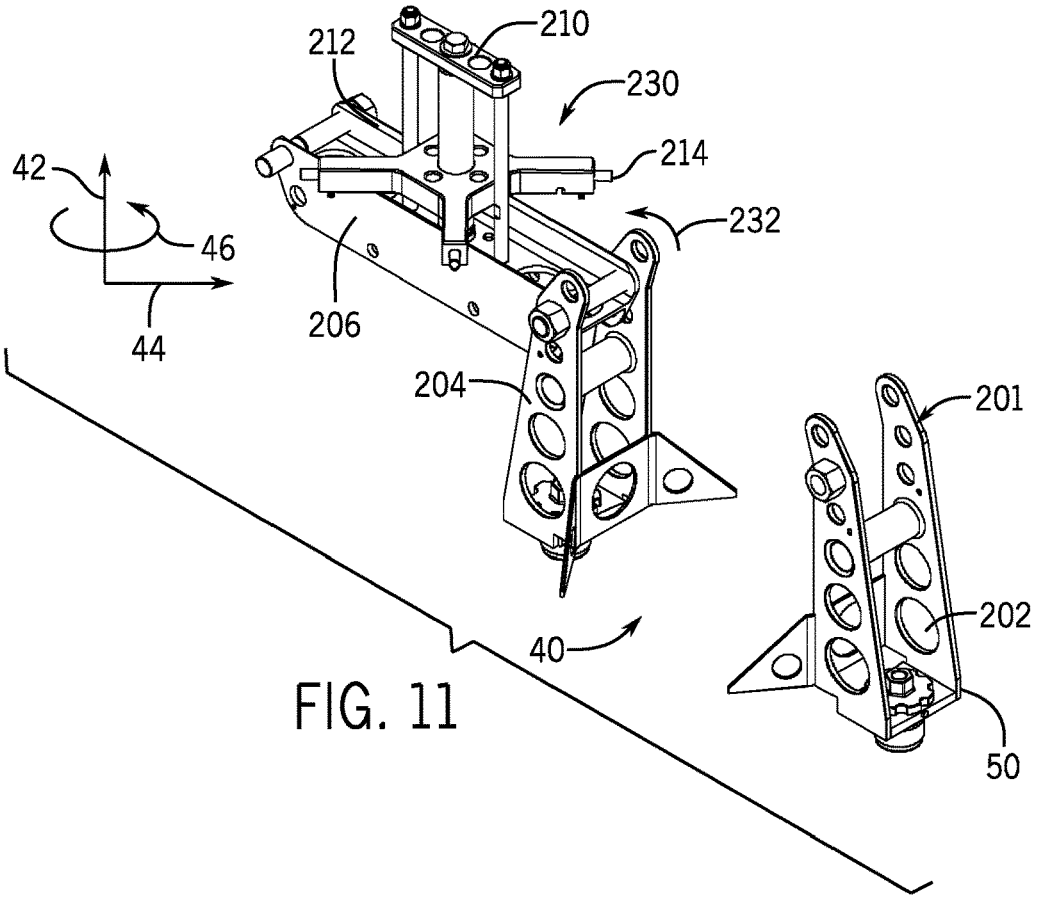
FIG. 11 is a perspective view of the tool of FIG. 11, wherein the tool is in an open position.

FIG. 11 illustrates an embodiment of the tool 200 in an open position 230. In the illustrated embodiment, the third arm 206 is detached from the first arm 202 and rotated about the respective rotatable coupling 208, as shown by arrow 232, to move the tool 200 into the open position 230. In the open position 230, the seal 30 and/or the inner surface 26 of the riser section 28 may be exposed and accessible for inspection and repair, for example.

As shown in FIGS. 10 and 11, a shaft 210 (e.g., threaded shaft) extends axially from the third arm 206. An engaging structure 212 having radially-expanding engaging members 214 is threadably coupled to the shaft 210 such that rotation of the shaft 210 causes the engaging structure 212 to move axially relative to the shaft 210, in a manner similar to that discussed above with respect to FIGS. 1-9. The engaging members 214 are configured to move between a retracted position and an expanded position to engage the recesses 110 of the seal 30 to enable the tool 200 to remove and/or install the seal 30 within the riser section 28, in a manner similar to that discussed above with respect to FIGS. 1-9.

As shown in FIG. 10, in certain embodiments, the tool 200 may include braces 216 extending from respective first ends 218 of the first and second arms 202, 204 and configured to contact the axially-facing surface 52 of the flange 50 when the tool 200 is coupled to the riser section 28. The braces 216 may generally provide additional support to the tool 200. In some embodiments, the third beam 206 may be a heavy, substantial I-beam structure configured to support the weight of the seal 30 and/or to support the high forces applied during installation and/or removal of the seal 30. Any of the features discussed with respect to the tool 40 shown in FIGS. 2-9 and the tool 200 shown in FIGS. 10 and 11 may be combined in any suitable manner. For example, the tool 40 may include multiple rotatable couplings (e.g., two couplings 208), braces (e.g., braces 216), or an I-beam structure. Additionally, the tool 200 and/or any of its features shown in FIGS. 10 and 11 may be used in any of the methods (e.g., method 196) disclosed herein to remove and/or install the seal 30 within the riser section 28.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A tool configured to facilitate installation or removal of a seal sub from an annular drilling or production structure, comprising:

a support structure configured to be coupled to the annular structure;

a shaft extending axially from the support structure, wherein the shaft is configured to rotate relative to the support structure; and an engaging structure coupled to the shaft, wherein the engaging structure comprises a plurality of engaging members and a plurality of springs, the plurality of springs are configured to bias a respective engaging member of the plurality of engaging members in respective radial directions between a retracted position that enables the engaging structure to be inserted into the seal sub and an extended position that enables the respective engaging member of the plurality of engaging members to engage corresponding recesses of the seal sub, and wherein the engaging members are configured to move in the radial directions independent of the rotation of the shaft.

2. The tool of claim 1, wherein the support structure is configured to be coupled to an axially-facing surface of an annular flange of the annular structure.

3. The tool of claim 1, wherein the shaft comprises a threaded shaft and the engaging structure is threadably coupled to the threaded shaft.

4. The tool of claim 1, wherein the support structure comprises a first arm and a second arm that are each configured to be coupled to the annular structure via a respective fastener.

5. The tool of claim 4, wherein the support structure comprises a U-shape, and the first arm and the second arm are positioned at 180 degrees relative to one another.

6. The tool of claim 4, wherein the first arm and the second arm are rotatably coupled to one another via a rotatable coupling.

7. The tool of claim 1, wherein each of the plurality of engaging members are biased radially outward by a respective biasing member.

8. The tool of claim 7, wherein each of the plurality of engaging members are coupled to a respective pin configured to extend through a respective recess formed in a wall of the engaging structure, wherein the respective recess is configured such that placement of the respective pin in one portion of the respective recess blocks the respective engaging member of the plurality of engaging members from moving radially to the extended position.

9. The tool of claim 1, wherein rotation of the shaft causes the engaging structure to move axially relative to the support structure.

10. A system configured to facilitate installation or removal of a seal sub from an annular drilling or production structure, comprising:

a tool, comprising:

a fastener configured to couple to a flange of the annular structure;

a support structure configured to be coupled to the flange of the annular structure with the fastener;

a threaded shaft extending along an axial axis from the support structure, wherein the threaded shaft is in a fixed position along the axial axis and is configured to rotate about the axial axis relative to the support structure; and an engaging structure threadably coupled to the threaded shaft and configured to expand along a radial axis to engage the seal sub.

11. The system of claim 10, wherein the support structure is configured to be coupled to an axially-facing surface of an annular flange of the annular structure.

12. The system of claim 10, wherein the support structure comprises a first arm and a second arm that are each configured to be coupled to the annular structure via a respective fastener.

13. The system of claim 12, wherein the support structure comprises a U-shape, and the first arm and the second arm are positioned at 180 degrees relative to one another.

14. The system of claim 12, wherein the first arm and the second arm are rotatably coupled to one another via a rotatable coupling.

15. The system of claim 12, comprising a third arm extending between the first arm and the second arm, wherein the third arm is rotatably coupled to each of the first arm and the second arm.

16. A method for installing or removing of a seal sub from an annular drilling or production structure, the method comprising:

coupling a first arm of a support structure of a tool to a flange of the annular structure with a first fastener;

coupling a second arm of the support structure of the tool to the flange of the annular structure with a second fastener;

driving a plurality of engaging members of the tool radially outward to engage corresponding recesses of the seal sub; and rotating an axially-extending shaft of the tool to drive the plurality of engaging members axially while the plurality of engaging members engage the corresponding recesses of the seal sub to install or to remove the seal sub from the annular structure.

17. The method of claim 16, comprising rotating the first arm relative to the second arm about a rotatable coupling that is positioned between and coupled to the first arm and the second arm to facilitate installing or removing the seal sub from the annular structure.

18. The method of claim 16, wherein coupling the tool to the annular structure comprises coupling the first arm to the annular structure and subsequently coupling the second arm to the first arm and to the annular structure.

19. The method of claim 16, comprising adjusting a respective pin coupled to each of the plurality of engaging members to enable a respective biasing member to drive each of the plurality of engaging members radially outward to engage the corresponding recesses of the seal sub.

* * * * *